US009488111B2

(12) United States Patent
Gibson, II

(10) Patent No.: US 9,488,111 B2
(45) Date of Patent: Nov. 8, 2016

(54) DUAL-PORT THROTTLE BODY

(71) Applicant: Arthur Ellis Gibson, II, Oklahoma City, OK (US)

(72) Inventor: Arthur Ellis Gibson, II, Oklahoma City, OK (US)

(73) Assignee: Zac R. Henderson, Edmond, OK (US)

( * ) Notice: Subject to any disclaimer, the term of this patent is extended or adjusted under 35 U.S.C. 154(b) by 134 days.

(21) Appl. No.: 14/505,313

(22) Filed: Oct. 2, 2014

(65) Prior Publication Data

US 2015/0096532 A1 Apr. 9, 2015

Related U.S. Application Data

(60) Provisional application No. 61/886,427, filed on Oct. 3, 2013.

(51) Int. Cl.
*F02D 9/10* (2006.01)

(52) U.S. Cl.
CPC ..... *F02D 9/104* (2013.01); *F02D 9/1095* (2013.01)

(58) Field of Classification Search
CPC .... F02M 17/34; F02M 19/08; F02M 69/044; F02M 61/14; F02M 61/145
USPC ..... 123/337, 470
See application file for complete search history.

(56) References Cited

U.S. PATENT DOCUMENTS

| | | | | |
|---|---|---|---|---|
| 4,139,583 | A | 2/1979 | Riley et al. | |
| 5,394,846 | A | 3/1995 | Jaeger et al. | |
| 5,522,361 | A | 6/1996 | Pickman et al. | |
| D375,102 | S | 10/1996 | DeHimer | |
| 5,916,831 | A | 6/1999 | Jager et al. | |
| 5,924,398 | A | 7/1999 | Choi | |
| 6,263,917 | B1 * | 7/2001 | Evans | F02D 9/101 137/595 |
| 6,290,215 | B1 * | 9/2001 | Pinsker | F02D 9/16 123/439 |
| 6,454,242 | B1 | 9/2002 | Garrick et al. | |
| 6,764,062 | B1 | 7/2004 | Daly | |
| 7,114,476 | B1 | 10/2006 | Wimmer | |
| 7,493,888 | B2 | 2/2009 | Ikegawa | |
| 7,607,413 | B2 | 10/2009 | Bamber et al. | |
| 7,735,475 | B2 * | 6/2010 | Farrell | F02M 35/10032 123/336 |
| 8,181,728 | B2 | 5/2012 | Hartland et al. | |
| 8,316,820 | B1 | 11/2012 | Cammarata | |
| 2008/0184955 | A1 | 8/2008 | Prior | |
| 2009/0145406 | A1 * | 6/2009 | Farrell | F02M 35/10032 123/470 |
| 2009/0260906 | A1 | 10/2009 | Hartland et al. | |
| 2014/0084494 | A1 * | 3/2014 | Bonde | F02M 19/10 261/44.2 |

FOREIGN PATENT DOCUMENTS

| | | | | |
|---|---|---|---|---|
| DE | 10308790 A1 * | 9/2004 | | F02D 9/104 |
| JP | EP 0226814 A2 * | 7/1987 | | F02D 9/1095 |

* cited by examiner

*Primary Examiner* — Marguerite McMahon
*Assistant Examiner* — Tea Holbrook
(74) *Attorney, Agent, or Firm* — Dunlap Codding, P.C.

(57) ABSTRACT

A throttle body including a body having two ports extending through the body. The two ports arranged in a side-by-side relationship relative to one another. The body has a bridge positioned between the two ports, and the bridge having an inlet end and an outlet end. The bridge is configured to define a peak at the inlet end intersecting a line extending from a center of one port to a center of the other port.

14 Claims, 3 Drawing Sheets

DUAL-PORT THROTTLE BODY

CROSS REFERENCE TO RELATED APPLICATIONS

This application claims priority to U.S. Provisional Application Ser. No. 61/886,427, filed Oct. 3, 2013, the entire content of which is hereby expressly incorporated herein by reference.

BACKGROUND

A throttle body is instrumental in internal combustion engines by functioning to regulate the flow of air into the engine thereby regulating engine power. The throttle body is typically located downstream from an air cleaner or air filter and upstream of an air intake manifold and includes a throttle plate (e.g., one or more butterfly valves) which is movable between a closed position, one or more partially open positions, and a fully open position to regulate the flow of air into the air intake manifold of the engine.

In modern fuel-injected engines, throttle bodies are electronically controlled by the engine's control unit. A sensor or an airflow detector coupled with the throttle body sends throttle plate position information and/or airflow information to the engine control unit, and a sensor coupled with the vehicle's accelerator pedal receives driver input and/or detects the position of the accelerator pedal and sends information to the engine control unit. The engine control unit, in turn, controls an actuating mechanism coupled with the throttle plate and/or with the throttle body which moves the throttle plate between the closed position, the one or more partially open positions, and the fully open position to increase or decrease engine speed or power output and/or to maintain a minimum idling speed of the engine.

Some engines, such as V-shaped engines, include air intake manifolds with two separate portions and two separate intake ports which supply air to two groups of cylinders on both sides of the V-shape. For engines having two air intake manifold portions and/or intake ports a dual-port throttle body is generally used to supply airflow to both portions of the air intake manifold via the two intake ports. Throttle bodies with two output ports are commonly known as twin throttle bodies or dual-port throttle bodies and typically include a large intake opening upstream of the throttle plate and two output ports downstream of the throttle plate. Dual-port throttle body throttle plates are generally configured to include two butterfly valves actuated by a common shaft with each butterfly valve controlling airflow through one of the two output ports of the dual-port throttle body.

Dual-port throttle bodies have a wall structure or bridge separating the two ports. Consequently, air entering the throttle body encounters the wall structure. Depending of the configuration of the wall structure, the flow of air through the throttle body and into the intake manifold can be impeded in a way that detrimentally affects the performance of the engine. Current throttle bodies have various wall structure designs which impede the flow of air through the throttle body. For example, some throttle bodies have wall structures with large exposed surfaces positioned at blunt angles relative to the direction of the airflow through the throttle body and have abrupt contour changes which create high-pressure and low-pressure areas in the throttle body. Other wall structures impede airflow through the throttle body by increasing friction and by directing airflow through an oblique flow path relative to the output ports. Finally, some wall structures result in increased noise during engine operation and in decreased and/or sub-optimal volumes of air flowing into the engine, thereby reducing engine power and efficiency and decreasing gas mileage.

BRIEF DESCRIPTION OF THE DRAWINGS

Like reference numerals in the figures represent and refer to the same or similar element or function. Embodiments of the present disclosure may be better understood when consideration is given to the following detailed description thereof. Such description makes reference to the annexed pictorial illustrations, schematics, graphs, drawings, and appendices. In the drawings.

DETAILED DESCRIPTION OF EXEMPLARY EMBODIMENTS

Figure 1:
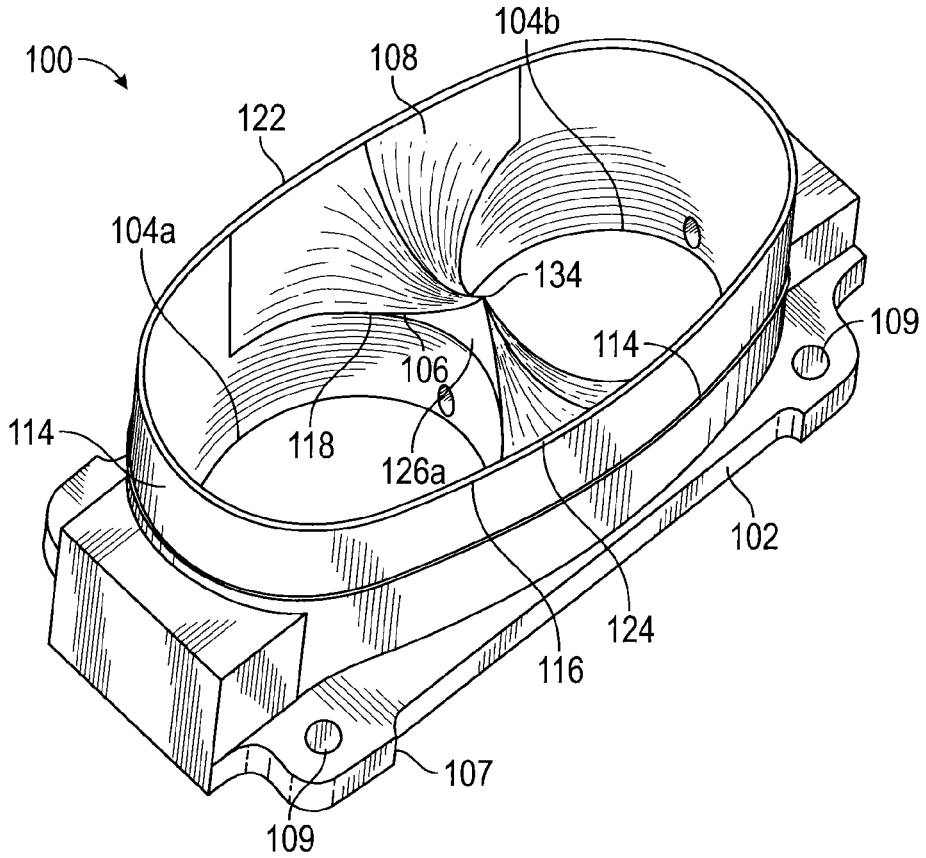
FIG. 1 is a perspective view of an exemplary embodiment of a throttle body according to the inventive concepts disclosed herein.
Figure 2:
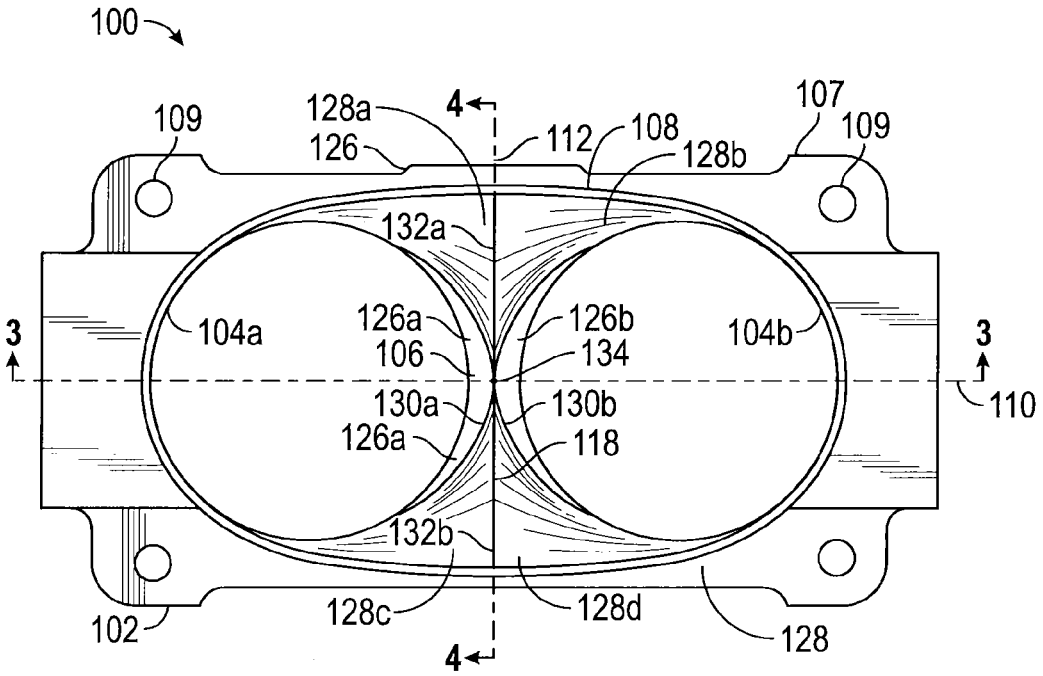
FIG. 2 is a top plan view of the throttle body of FIG. 1.

Before explaining at least one embodiment of the present disclosure in detail, it is to be understood that embodiments of the present disclosure are not limited in their application to the details of construction and the arrangement of the components or steps or methodologies set forth in the following description or illustrated in the drawings. The inventive concepts in the present disclosure are capable of other embodiments or of being practiced or carried out in various ways. Also, it is to be understood that the phraseology and terminology employed herein is for the purpose of description and should not be regarded as limiting.

Exemplary embodiments of the present disclosure will now be described in detail with reference to the accompanying drawings. Further, in the following detailed description of embodiments of the present disclosure, numerous specific details are set forth in order to provide a more thorough understanding of the disclosure. However, it will be apparent to one of ordinary skill in the art, that the embodiments disclosed herein may be practiced without these specific details. In other instances, well-known features have not been described in detail to avoid unnecessarily complicating the present disclosure.

As used herein, language such as "including," "comprising," "having," "containing," or "involving," and variations thereof, is intended to be broad and encompass the subject matter listed thereafter, equivalents, and additional subject matter not recited or inherently present therein.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of "a" or "an" is employed to describe elements and components of the embodiments herein. This is done merely for convenience and to give a general sense of the inventive concepts. This description should be read to include one or at least one and the singular also includes the plural unless it is obvious that it is meant otherwise.

Finally, as used herein any reference to "one embodiment" or "an embodiment" means that a particular element, feature, structure, or characteristic described in connection with the embodiment is included in at least one embodiment of the present disclosure. The appearances of the phrase "in one embodiment" in various places in the present disclosure are not necessarily all referring to the same embodiment, although the inventive concepts in the present disclosure are intended to encompass any and all combinations, subcombinations, and permutations of the features described or inherently present herein.

Embodiments of the inventive concepts disclosed herein are directed to dual-port throttle bodies having wall structures configured to include gradual contour changes and to minimize blunt angles and surfaces inside the throttle body so as to promote increased airflow through the throttle bodies which provides increased engine power and efficiency.

In some embodiments, a dual-port throttle body according to the present disclosure includes a base portion and an inlet portion and two output ports opening at the base portion and at the inlet portion. The two output ports are separated from one another by a wall structure positioned between the two output ports and having an inlet end and an outlet end.

The inlet end of the wall structure is configured to efficiently separate incoming air into two output streams by including gradual contour changes and minimal blunt angles and surfaces. In some embodiments, the inlet end includes a plurality of surfaces intersecting with one another (e.g., at acute angles) so as to minimize the blunt angles and surfaces used by the wall structure to separate incoming air flow into two output streams and to direct the two output streams into an engine's intake manifold and/or cylinders via the two output ports. The plurality of surfaces intersect with one another (e.g., at acute angles) to define two or more ridges and a point or peak at the inlet end of the wall structure. The ridges and the peak are shaped, angled, and/or otherwise configured to efficiently cut or separate the incoming air into the two output streams by having gradual contour changes from the inlet end toward the outlet end of the wall structure.

By including wall structures having an inlet end according to the inventive concepts disclosed herein, embodiments of dual-port throttle bodies according to the present disclosure promote increased airflow and engine power and efficiency and greater gas mileage by minimizing contour changes and blunt angles and surfaces inside the throttle body.

Referring now to FIGS. 1-4, an exemplary embodiment of a throttle body 100 according to the inventive concepts disclosed herein is illustrated. The throttle body 100 has a body 102 having two ports 104*a* and 104*b* separated from one another by a wall structure or bridge 106. The body 102 includes a base portion 107 and an inlet portion 108. The body 102 is characterized as having a longitudinal axis 110 (FIG. 2) and a lateral axis 112 (FIG. 2) extending substantially perpendicularly to the longitudinal axis 110. The body 102 can be constructed of any desired materials such as metals, alloys, aluminum, non-metals, polymers, plastics, resins, or combinations thereof, and can be manufactured via any desired technique such as press-molding, injection molding, die-casting, stamping, machining, or combinations thereof. While the body 102 is shown as being generally oval in shape, the body 102 can have any desired shape, such as circular, triangular, rectangular, irregular, or combinations thereof.

The base portion 107 is configured to attach the throttle body 102 to an engine intake manifold (not shown). To this end, the base portion 107 has a plurality of attachment openings 109 formed therein. The attachment openings 109 are configured to receive one or more fasteners therein so as to secure the base portion 107 to the engine intake manifold. The base portion 107 may have be sized and dimensioned so as to securely engage the throttle body 102 to the engine manifold and such that the ports 104*a* and 104*b* register or align with corresponding intake ports of the engine intake manifold.

The inlet portion 108 includes an air intake conduit attachment notch 114 and a lip 116 formed therein so as to facilitate a secure attachment of an air intake conduit (now shown) to the body 102 (e.g., via one or more clamps).

The two ports 104*a* and 104*b* extend through the body 102 and are arranged in a side-by-side relationship relative to one another. The ports 104 and 104*b* are spaced a distance to register or align with two corresponding intake ports of an engine intake manifold. The ports 104*a* and 104*b* are formed in the body 102 in any desired manner and have any desired size, shape, and/or cross-section. In some embodiments, the ports 104*a* and 104*b* have a substantially circular shape and diameters varying from about 52 mm to about 67 mm.

The bridge 106 extends between the ports 104*a* and 104*b* so as to separate the two ports 104*a* and 104*b* from one another. The bridge 106 has an inlet end 118 positioned adjacent to the inlet portion 108 of the body 102 and an outlet end 120 positioned adjacent to the base portion 107 of the body 102. In some exemplary embodiments, the bridge 106 may extend along the lateral axis 112 of the body 102 between a first side 122 and a second side 124 of the body 102.

The bridge 106 is configured to promote increased air flow through the ports 104*a* and 104*b*. More particularly, the inlet end 118 includes a plurality of surfaces formed in a way that causes air entering the body 102 to flow around the bridge 106 more efficiently. In one embodiment, the bridge 106 includes a first medial surface 126*a*, a second medial surface 126*b*, and four lateral surfaces 128*a*-128*d* contoured, intersecting, and cooperating with one another as will be described below.

Figure 3:
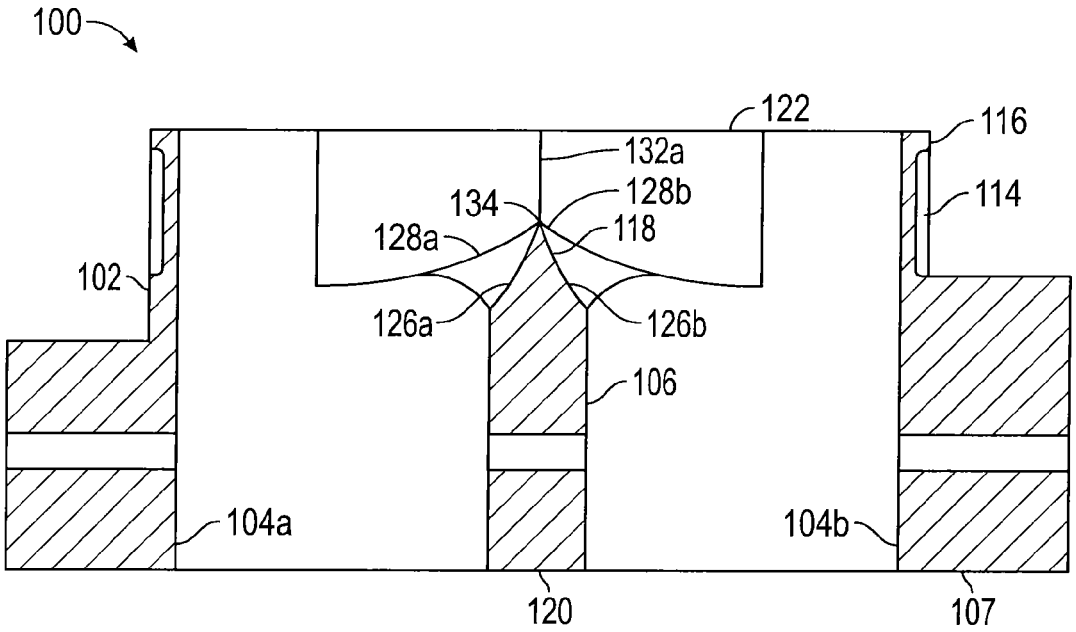
FIG. 3 is a cross-sectional view taken along line 3-3 of FIG. 2.

The first medial surface 126*a* and the second medial surface 126*b* extend from the inlet end 118 toward the outlet end 120, as shown in FIG. 3, such that the first medial surface 126*a* and the second medial surface 126*b* terminate a distance from the outlet end 120 of the bridge 106. However, it will be appreciated that the first and second medial surfaces 126*a* and 126*b* may extend to the outlet end 120.

The first and second medial surfaces 126*a* and 126*b* oppose one another and are tapered inwardly toward the inlet end 118 of the bridge 106 so that the first and second medial surfaces 126*a* and 126*b* are angled relative to one another. The first and second medial surfaces 126*a* and 126*b* may be contoured to have a concave shape for directing air into the ports 104*a* and 104*b*. The angle between the first and second medial surfaces 126*a* and 126*b* is shown to be about 30°. However, it will be appreciated that the angle between the first and second medial surfaces 126*a* and 126*b* can be varied from greater than 0 degrees to about 45 degrees.

The first lateral surface 128*a* and the second lateral surface 128*b* extend from the first side 122 of the body 102 toward the first and second medial surfaces 126*a* and 126*b* and are angled relative to one another to form a first ridge 132*a*. The angle between the first lateral surface 128*a* and the second lateral surface 128*b* is greater than the angle between the first and second medial surfaces 126*a* and 126*b*. The angle between first and second lateral surfaces 128*a* and 128*b* is shown to be about 60 degrees. However, it will be appreciated that the angle between first and second lateral surfaces 128*a* and 128*b* can vary so long as the angle is greater than the angle between the first and second medial surfaces 126*a* and 126*b*.

Figure 4:
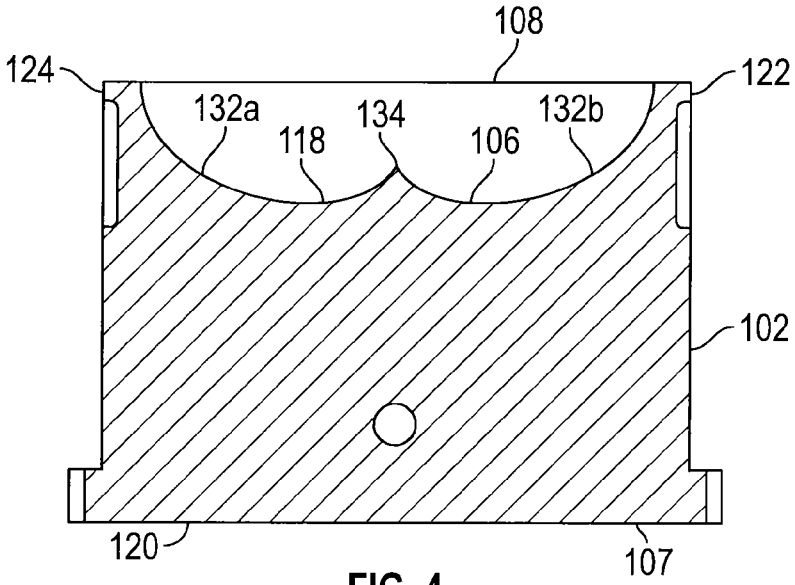
FIG. 4 is a cross-sectional view taken along line 4-4 of FIG. 2.

Like the first and second medial surfaces 126*a* and 126*b*, the first and second lateral surfaces 128*a* and 128*b* may be contoured to have a concave shape. To this end, the first ridge 132*a* is substantially U-shaped, as best illustrated in FIG. 4.

The third lateral surface 128*c* and the fourth lateral surface 128*d* extend from the second side 124 of the body 102 toward the first and second medial surfaces 126*a* and 126*b* and are angled relative to one another to form a second ridge 132*b*. The angle between the third lateral surface 128*c* and the second lateral surface 128*d* is greater than the angle between the first and second medial surfaces 126*a* and 126*b*. Again, the angle between first and second lateral surfaces 128*a* and 128*b* is shown to be about 60 degrees. However, it will be appreciated that the angle between third and fourth lateral surfaces 128*c* and 128*d* can vary so long as the angle is greater than the angle between the first and second medial surfaces 126*a* and 126*b*.

Like the first and second lateral surfaces 128*a* and 128*b*, the third and fourth lateral surfaces 128*c* and 128*d* may be contoured to have a concave shape. To this end, the second ridge 132*b* is substantially U-shaped, as best illustrated in FIG. 4.

Due to the intersection of the first and second medial surfaces 126*a* and 126*b* and the U-shape of the first ridge 132*a* and the U-shape of the second ridge 132*b*, the bridge 106 is configured to define a peak 134 at the inlet end 118. The peak 134 is formed to intersect a line extending from a center of one port 104*a* to a center of the other port 104*b*. The peak 134 is shown as having a pointed end, but it should be appreciated that the peak 134 may be configured to have a rounded or truncated configuration.

Figure 5:
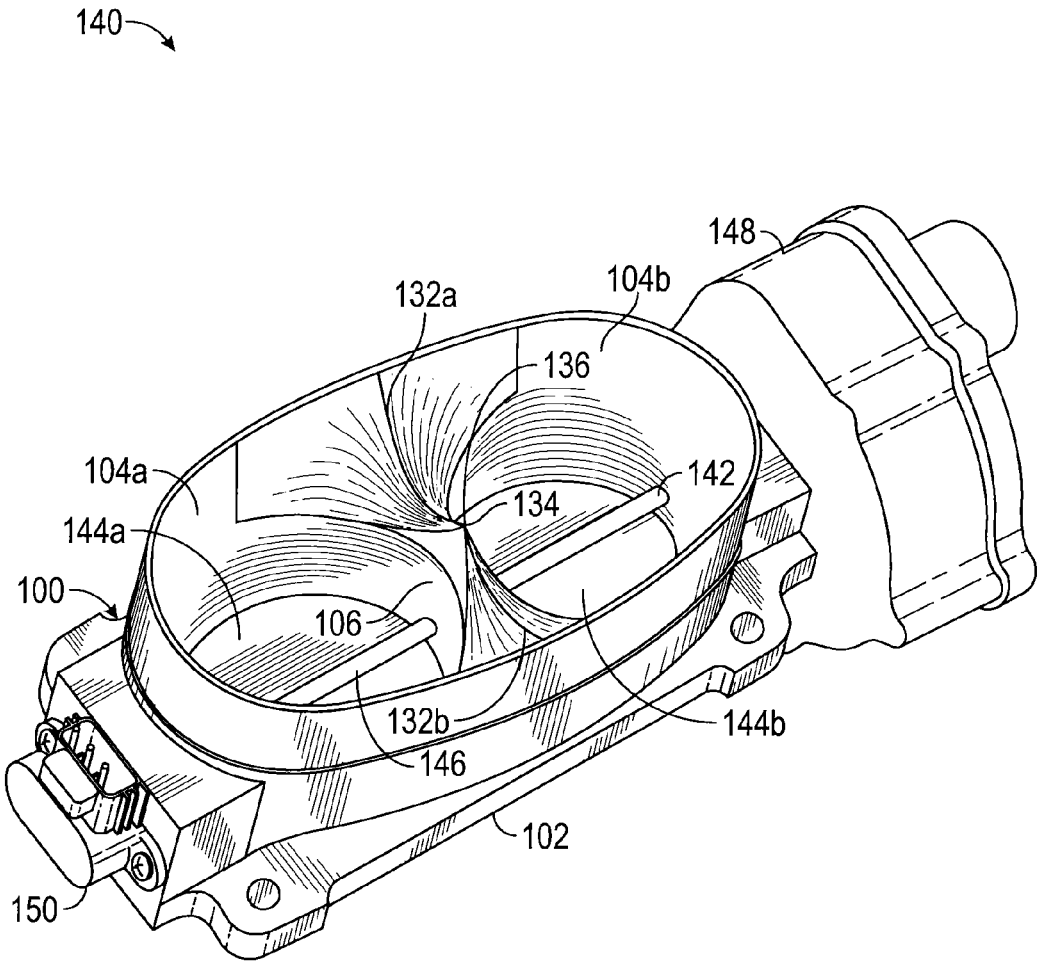
FIG. 5 is a perspective view of a throttle body assembly including the dual-port throttle body of FIG. 1.

Referring now to FIG. 5, shown therein is a throttle body assembly 140 comprising the throttle body 100 and a valve assembly 142. The valve assembly 142 includes a first butterfly valve 144*a* and a second butterfly valve 144*b* coupled with a common shaft 146 and an actuating mechanism 148 operably coupled with one end of the shaft 146. A position sensor 150 is shown coupled with the other end of the shaft 146 so as to be able to detect a position of the shaft 146 thereby determining the positions of the first butterfly valve 144*a* and the second butterfly valve 144*b*, and to provide one or more position signals to an engine's control unit via an output port.

The first butterfly valve 144*a* is operably supported in the first port 104*a*, and the second butterfly valve 144*b* is operably supported in the second port 104*b* so that the first and second butterfly valves 144*a* and 144*b* are movable between a fully closed position, two or more partially open positions, and a fully open position by the actuating mechanism 148 so as to regulate airflow through the first and second ports 104*a* and 104*b*.

The actuating mechanism 148 can be implemented as any suitable mechanism, such as gears, pneumatic actuator, electrical actuator, electrical motor, and combinations thereof, and is configured to actuate or move (e.g., gradually) the first and second butterfly valves 144*a* and 144*b* between the fully closed position, the two or more partially open positions, and the fully open position, in response to one or more control signals provided to the actuating mechanism 148 from an engine control unit (not shown) via an input port as will be appreciated by persons of ordinary skill in the art having the benefit of the instant disclosure.

An air intake conduit (not shown) can be coupled with the inlet portion 108 via the air intake conduit attachment notch 114 and/or the lip 116 so as to deliver a volume of air to the body 102. As the volume of air flows into the body 102, the volume of air encounters the bridge 106 and is efficiently separated into two output streams of air, each of which is directed through the first port 104*a* and the second port 104*b*. From there, the two output streams of air flow into two portions of an engine's intake manifold and/or flow into one or more cylinders of an engine.

The peak 134 and the first and second ridges 132*a* and 132*b* cooperate with one another to efficiently separate an incoming air stream into two output streams so as to increase the volume of air flowing through the throttle body 100 and into the engine's intake manifold and/or cylinders. The throttle plate assembly 142 is configured to control the volume of air flowing through the throttle body 100 so as to regulate the speed of the engine.

As will be appreciated by persons of ordinary skill in the art having the benefit of the instant disclosure, dual-port throttle bodies constructed according to embodiments of the present disclosure promote increased airflow by minimizing contour changes and blunt angles and surfaces inside the throttle body and result in increased engine power and efficiency and greater gas mileage.

From the above description, it is clear that the embodiments of the present disclosure are well adapted to carry out the objects and to attain the advantages mentioned herein as well as those inherent in the embodiments of the present disclosure. While exemplary embodiments of the present disclosure have been described, it will be understood that numerous changes may be made which will readily suggest themselves to those skilled in the art and which are accomplished within the scope of the present disclosure and as defined in the appended claims.

What is claimed is:

1. A throttle body, comprising:

a body having two ports extending through the body, the two ports arranged in a side-by-side relationship relative to one another, wherein the body has a bridge extending substantially from one side of the body to an opposite side of the body and positioned between the two ports in a perpendicular relationship to a line extending from a center of one port to a center of the other port, the bridge having an inlet end and an outlet end, the bridge configured to define a peak at the inlet end, the peak tapering to a point and the point intersecting the line extending from the center of one port to the center of the other port.

2. The throttle body of claim 1, wherein the body has a longitudinal axis and a lateral axis, and wherein the point of the peak intersects the longitudinal axis and the lateral axis.

3. The throttle body of claim 1, wherein the inlet end of the bridge is configured to define a first ridge extending from one side of the body to the peak and a second ridge extending from an opposing side of the body to the peak.

4. The throttle body of claim 3, wherein the first ridge is substantially U-shaped.

5. The throttle body of claim 4, wherein the second ridge is substantially U-shaped.

6. The throttle body of claim 3, wherein the body has an inlet portion, and wherein the first ridge extends to the inlet portion of the body.

7. The throttle body of claim 6, wherein the second ridge extends to the inlet portion of the body.

8. A throttle body assembly, comprising:

a throttle body having two ports extending through the body, the two ports arranged in a side-by-side relationship relative to one another, and a bridge extending substantially from one side of the body to an opposite side of the body and positioned between the two ports in a perpendicular relationship to a line extending from a center of one port to a center of the other port, the bridge having an inlet end and an outlet end, the bridge configured to define a peak at the inlet end, the peak tapering to a point and the point intersecting the line extending from the center of one port to the center of the other port; and a valve assembly including two butterfly valves supported in the two ports and an actuator operably coupled with the two butterfly valves.

9. The throttle body assembly of claim 8, wherein the throttle body has a longitudinal axis and a lateral axis, and wherein the point of the peak intersects the longitudinal axis and the lateral axis.

10. The throttle body assembly of claim 8, wherein the inlet end of the bridge is configured to define a first ridge extending from one side of the throttle body to the peak and a second ridge extending from an opposing side of the throttle body to the peak.

11. The throttle body assembly of claim 10, wherein the first ridge is substantially U-shaped.

12. The throttle body assembly of claim 11, wherein the second ridge is substantially U-shaped.

13. The throttle body of claim 10, wherein the throttle body has an inlet portion, and wherein the first ridge extends to the inlet portion of the throttle body.

14. The throttle body assembly of claim 13, wherein the second ridge extends to the inlet portion of the throttle body.

* * * * *